US006778800B2

(12) United States Patent
Shim et al.

(10) Patent No.: US 6,778,800 B2
(45) Date of Patent: Aug. 17, 2004

(54) SQUEEZING DEVICE OF A WET PRINTER AND A DEVELOPING UNIT EMPLOYING THE SAME

(75) Inventors: Woo-jung Shim, Suwon (KR); Chung-guk Baek, Suwon (KR)

(73) Assignee: Samsung Electronics Company, Ltd., Kyungki-Do (KR)

( * ) Notice: Subject to any disclaimer, the term of this patent is extended or adjusted under 35 U.S.C. 154(b) by 0 days.

(21) Appl. No.: 10/046,711

(22) Filed: Jan. 17, 2002

(65) Prior Publication Data

US 2002/0141786 A1 Oct. 3, 2002

(30) Foreign Application Priority Data

Feb. 21, 2001 (KR) ..... 2001-8777

(51) Int. Cl.[7] ..... G03G 15/10
(52) U.S. Cl. ..... 399/249
(58) Field of Search ..... 399/237, 249, 399/250, 251

(56) References Cited

U.S. PATENT DOCUMENTS 6,049,684 A * 4/2000 Nishikawa et al. ..... 399/249
6,085,054 A * 7/2000 Kusayanagi ..... 399/249
6,104,901 A * 8/2000 Imamiya ..... 399/249
6,205,312 B1 * 3/2001 Kim ..... 399/249
6,253,051 B1 * 6/2001 Iikura et al. ..... 399/249

* cited by examiner

*Primary Examiner*—Sandra Brase
(74) *Attorney, Agent, or Firm*—Sughrue Mion, PLLC

(57) ABSTRACT

A squeezing device of a wet printer for separating a liquid carrier element that is not used for forming an image from ink supplied to the photosensitive belt, includes a squeezing roller mounted to be opposite to the photosensitive belt, a bias applying unit for biasing the squeezing roller with a certain potential, and a plurality of backup rollers mounted side by side to be opposite to the squeezing roller across the photosensitive belt placed between the plurality of backup rollers and the squeezing roller, in order to extend a contact width between the photosensitive belt and the squeezing roller. A printer to which the squeezing device of a wet printer is applied secures a sufficient charging time of the photosensitive belt and lowers a voltage for generating a townsend discharge, to thereby enhance charging performances and printing qualities.

9 Claims, 5 Drawing Sheets

SQUEEZING DEVICE OF A WET PRINTER AND A DEVELOPING UNIT EMPLOYING THE SAME

BACKGROUND OF THE INVENTION

1. Field of the Invention

The present invention relates to a squeezing device of a wet printer and a developing unit employing the same, and more particularly to a squeezing device of a wet printer and a developing unit, capable of stabilizing image forming conditions for a photosensitive medium. The present application is based on Korean Patent Application No. 2001-8777, which is incorporated herein by reference.

2. Description of the Related Art

FIG. 1 is a view for schematically showing a general wet printer.

As shown in FIG. 1, a wet printer is equipped with a photosensitive belt 1, light scanning units 4, a transfer unit 7, and a plurality of developing units 10.

The light scanning units 4 each scan light to the photosensitive belt 1 charged with a certain potential to correspond to image information. The developing units 10 are provided for the respective colors, supply ink to the photosensitive belt 1, and develop an electrostatic latent image that is formed on the photosensitive belt 1 by the light scanning units 4. The transfer unit 7 transfers a toner image formed on the photosensitive belt 1 to supplied sheets of paper.

The developing units 10 include a container 16 for reserving ink mixed with liquid carrier element and toner in a predetermined ratio, developing rollers 12, ink suppliers 17 for supplying ink of certain colors reserved in the containers 16 between the photosensitive belt 1 and the developing rollers 12, setup rollers 13, and squeezing rollers 14.

The developing rollers are each installed to form a nip which is a minute gap from the photosensitive belt 1, and biased with a certain potential to fix supplied ink on an electrostatic latent image region of the photosensitive belt 1 by an electric force. The setup rollers 13 are installed to form a minute gap from the photosensitive belt 1 in order to separate ink oversupplied to the photosensitive belt 1 from the photosensitive belt 1 by the surface tension.

The squeezing rollers 14 separate the liquid carrier element not participating in the formation of an image from the photosensitive belt 1 and collect the separated liquid carrier element into a collecting reservoir 11.

A reference numeral 15 indicates backup rollers each of which restrains the looseness of the photosensitive belt 1 and supports the squeezing roller 14 to stably contact the photosensitive belt 1.

As shown in FIG. 2, between the squeezing rollers 14 and the photosensitive belt 1 are defined squeeze nips that are contact regions for the squeezing roller 14 and the photosensitive belt 1. Substantially, these squeeze nips may be minute gaps between the squeezing rollers 14 and the photosensitive belt 1 which are positioned side by side at a certain distance from each other.

The squeezing rollers 14 include a core 14*a* of a conductive material and a contact layer 14*b* of a rubber material surrounding the outer circumference of the core 14*a*. Further, the squeezing rollers 14 can apply a bias potential to the core 14*a* in order to build a condition in which another electrostatic latent image of another color is to be formed on the photosensitive belt 1.

Ink developed on the photosensitive belt 1 has conductivity, but the liquid carrier included in the ink is a dielectric substance preventing electricity from flowing. However, if an electric field stronger than a critical potential is applied to the squeeze nips, a townsend discharge occurs so that electric currents flow in the carrier. Accordingly, in order to charge the photosensitive belt 1, a bias voltage over the critical potential should be applied to the core 14*a* of the squeezing roller 14, which could enable currents to flow from the squeezing rollers 14 to the photosensitive belt 1.

The charging performance of the squeezing rollers 14 varies with a critical potential related to the townsend discharge occurrence, a time constant to be determined by characteristics of the squeezing rollers 14 and the photosensitive belt 1, and a charging time.

Meanwhile, in a conventional developing unit 10, since the squeezing rollers 14 are supported by one cylindrical backup roller 15 and contacted with the photosensitive belt 1, the width of the squeeze nip formed between the photosensitive belt 1 and the squeezing roller 14 is short. The shortness of the squeeze nip means that time required to charge the photosensitive belt 1 by the squeezing rollers 14 is short. Accordingly, in the conventional developing unit 10, since the charging time for the photosensitive belt 1 is so short that the photosensitive belt 1 is not charged with an even potential in order for an electrostatic latent image to be formed for different colors, there exists a problem in that a printing quality is deteriorated.

Further, in the conventional developing unit 10, since a resistance of the contact layer 14*b* of each of the squeezing rollers 14 varies with changing temperature, a critical potential for the townsend discharge occurrence varies. Accordingly, since a charging potential of the photosensitive belt 1 varies with temperature, there exists a problem in that an optimum image formation condition changes.

SUMMARY OF THE INVENTION

The present invention has been devised to solve the above problems of the related art, and accordingly, it is an object of the present invention to provide a squeezing device and a developing unit employing the same, capable of securing charging time sufficiently.

Another object of the present invention is to provide a squeezing device that is stable with temperature changes and a developing unit employing the same.

The above object is accomplished by a squeezing device of a wet printer for separating a liquid carrier element not used for forming an image from ink supplied to a photosensitive belt in accordance with the present invention, including a squeezing roller mounted to be contacted with the photosensitive belt, a bias applying unit for biasing the squeezing roller at a certain potential, and a plurality of backup rollers mounted side by side to be opposite to the squeezing roller across the photosensitive belt, which is placed between the plurality of backup rollers and the squeezing roller.

The squeezing roller includes a core to which a bias potential is applied to charge the photosensitive belt by the bias applying unit, and a contact layer surrounding an outer circumference of the core, and preferably further includes a heater mounted in the core for heating the contact layer.

The above object is also accomplished by a developing unit of a wet printer for developing an electrostatic latent image by supplying ink to a photosensitive belt in accordance with the present invention, including an ink supplying unit for supplying ink to the photosensitive belt, a squeezing roller mounted in contact with the photosensitive belt for separating liquid carrier element, which is not used for forming an image, from the ink supplied to the photosensitive belt, a bias applying unit for biasing the squeezing roller at a certain potential, and a heater for heating the squeezing roller.

Another object is accomplished by a squeezing device having a squeezing roller mounted to be contacted with the photosensitive belt, a bias applying unit for biasing the squeezing roller at a certain potential, and a heater for heating a surface of the squeezing roller at a certain temperature.

Another object of the present invention is also accomplished by a developing unit of a wet printer for developing an electrostatic latent image by supplying ink to the photosensitive belt in accordance with the present invention, including an ink supplying unit for supplying ink to the photosensitive belt, a squeezing roller mounted in contact with the photosensitive belt for separating liquid carrier element, which is not used for forming an image, from the ink supplied to the photosensitive belt, a bias applying unit for biasing the squeezing roller at a certain potential, and a plurality of backup rollers mounted side by side to be opposite to the squeezing roller across the photosensitive belt, which is placed between the plurality of backup rollers and the squeezing roller.

It is preferable that the developing unit further includes a heater for heating the squeezing roller.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

Figure 1:
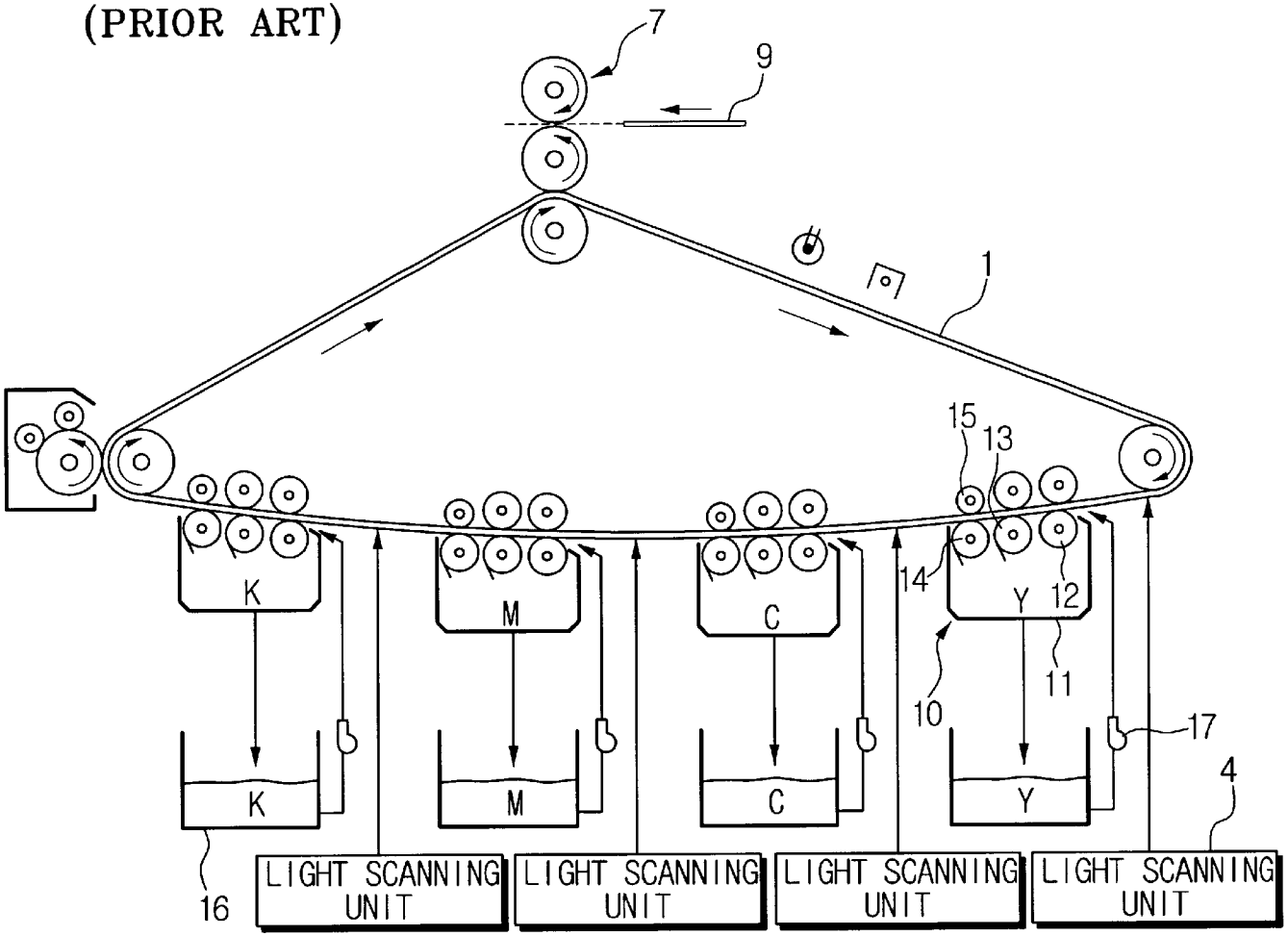
FIG. 1 (PRIOR ART)
FIG. 1 is a view for schematically showing a general wet printer.

Hereinafter, a preferred embodiment of the present invention will be described in detail with reference to the accompanying drawings.

The same reference numerals are given to the same constituents as shown in the related art, and detailed descriptions thereof will be omitted.

Figure 3:
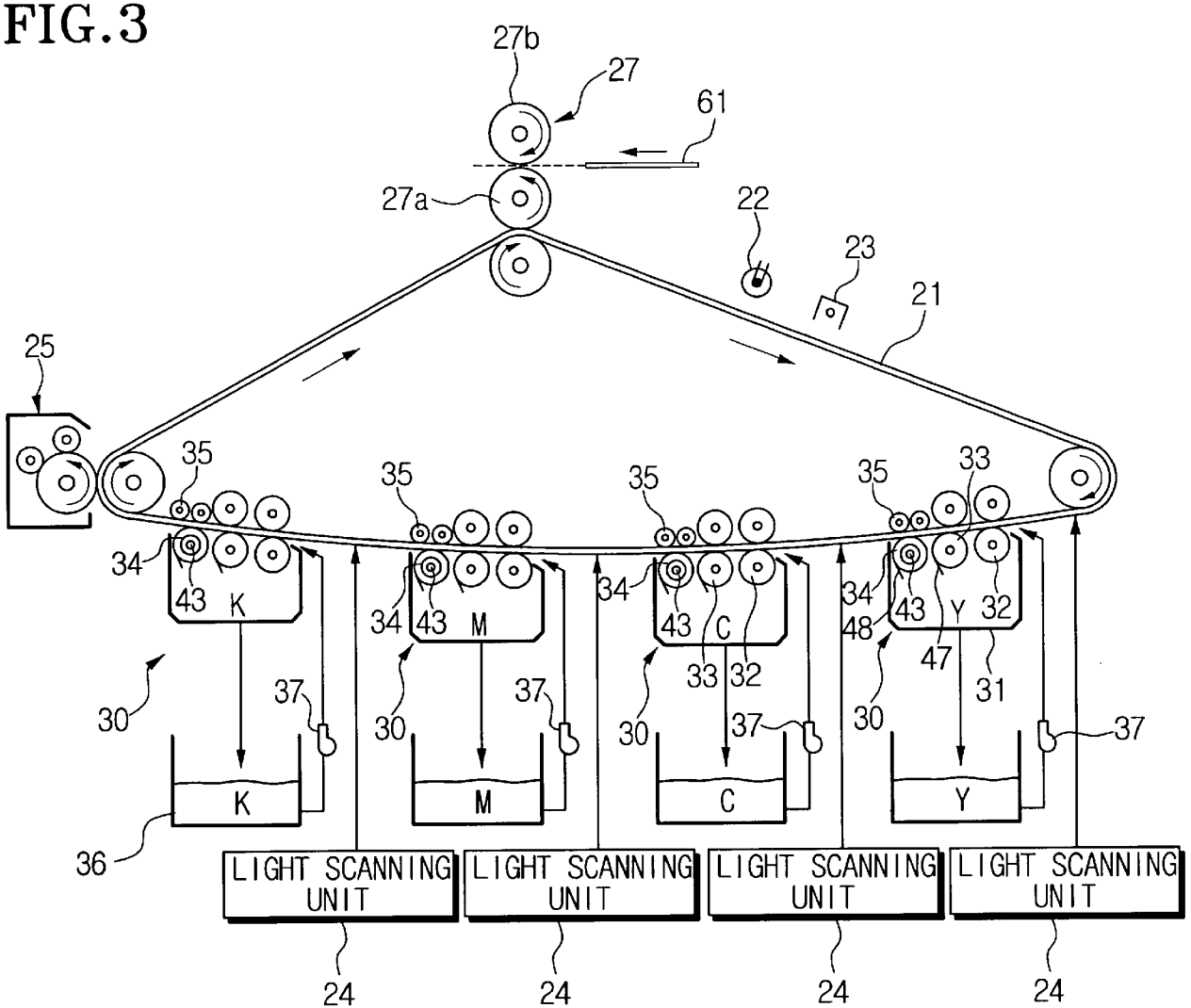
FIG. 3 is a view for showing a wet printer to which the squeezing device according to an embodiment of the present invention is applied.

FIG. 3 is a view for showing a printer to which a squeezing device according to the present invention is applied, actually a four-color printer enabling color printings.

As shown in FIG. 3, a printer is equipped with a photosensitive belt 21, a plurality of light scanning units 24 and developing units 30, a drying unit 25, and a transferring unit 27.

A reference numeral 22 denotes an eraser for erasing a remaining electrostatic latent image by radiating light to the photosensitive belt 21, and a reference numeral 23 is a charger for charging the photosensitive belt 21 with a predetermined potential in order to enable a new electrostatic latent image to be formed on the photosensitive belt 21.

The plurality of light scanning units 24 scan the photosensitive belt 21 with lights corresponding to image information of four colors of yellow (Y), cyan (C), magenta (M), and black (K) respectively. The plurality of developing units 30 supply yellow (Y), cyan (C), magenta (M), and black (K) inks to the photosensitive belt 21 to develop an electrostatic latent image that is formed on the photosensitive belt 21 by the light scanning units 24. The drying unit 25 evaporates the liquid carrier element remaining on the photosensitive belt 21. The transferring unit 27 includes a transferring roller 27*a* and a pressing roller 27*b*, and transfers a toner image formed on the photosensitive belt 21 to supplied sheets of paper 61.

Each developing unit 30 includes a container 36, an ink supplier 37, a developing roller 32, a setup roller 33, and a squeezing roller 34 and a plurality of backup rollers 35 and 36 as a squeezing device.

Installed around the setup roller 33 and squeezing roller 34 are blades 47 and 48 that are tangentially contacted to outer circumferences of the setup roller 33 and the squeezing roller 34, respectively. The blade 47, which is contacted with the setup roller 33, drops into a collecting reservoir 31 an excess of ink that is oversupplied to the photosensitive belt 21 and collected by the setup roller 33. The blade 48, which is contacted with the squeezing roller 34, drops into the collecting reservoir 31 an excess of the liquid carrier element that is oversupplied to the photosensitive belt 21 and collected by the squeezing roller 34.

In the above structure, the setup roller 33 and the blade 47 may be omitted in case that the developing roller 32 can supply an appropriate amount of ink to the photosensitive belt 21.

Figure 4:
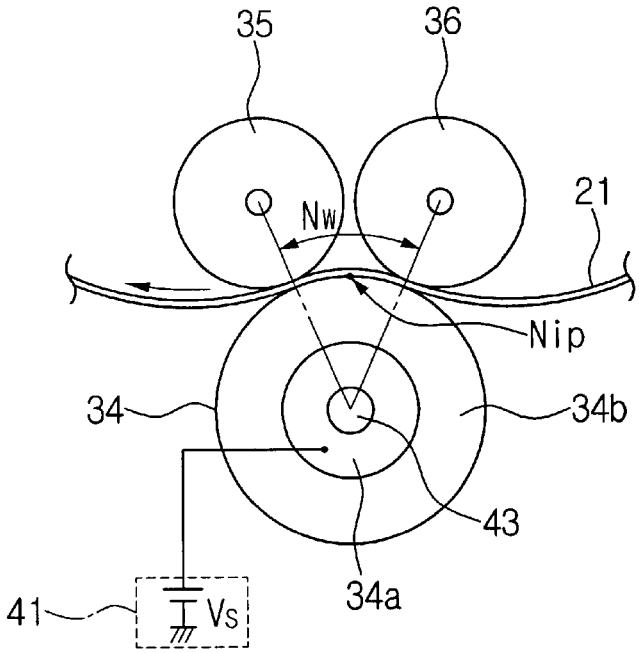
FIG. 4 is a view for schematically showing the squeezing device according to a preferred embodiment of the present invention.

As shown in FIG. 4, a squeezing device according to the present invention includes the squeezing roller 34, a heater installed in the squeezing roller 34, a plurality of backup rollers 35 and 36 opposite to the squeezing roller 34, with the photosensitive belt 21 placed between the rollers 34, 35, and 36, and a bias applying unit 41 for applying a predetermined potential to the squeezing roller 34.

The squeezing roller 34 includes a core 34*a* of a conductive material and a contact layer 34*b* of a silicon substance contacted with the photosensitive belt 21. The core 34*a* is electrically connected to the bias applying unit 41, and has a cavity in which the heater 43 can be mounted.

The heater 43 increases a temperature of the silicon layer of the surface of the photosensitive belt 21 by increasing a temperature of the squeezing roller 34. A heating element such as a heat lamp can be applied as a heater 43.

Figure 2:
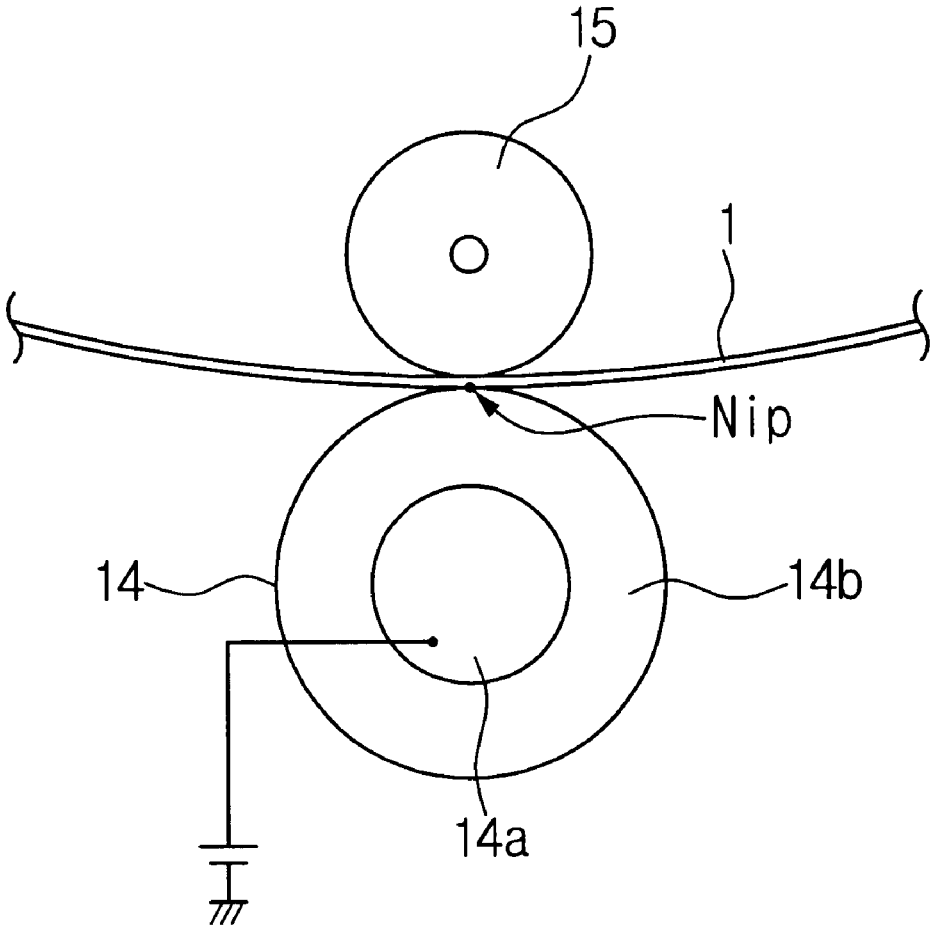
FIG.2 (PRIOR ART)
FIG. 2 is a view for showing a squeezing roller of FIG. 1 in detail.

The plurality of backup rollers 35 and 36 are arranged adjacent to each other in order for a contact area of the squeezing roller 34 and the photosensitive belt 21 to be more extended than that of the conventional developing unit (refer to FIG. 2). That is, by disposing the plurality of backup rollers 35 and 36, a width Nw of a nip formed between the photosensitive belt 21 and the squeezing belt 34 is extended more than that in the conventional developing unit that employs one backup roller. With the nip width Nw extended, a charging time of the photosensitive belt 21 by the squeezing roller 34 can be more extended than that in the conventional developing unit.

The nip width Nw can be nearly expressed as the following formula in case that the backup rollers 35 and 36 are the same size.

$$Nw = 2R_1 \mathrm{SIN}^{-1}\left(\frac{R2}{R1+R2}\right) \quad \text{[Formula 1]}$$

Here, $R_1$ is a radius of the squeezing roller 34, and $R_2$ is a radius of the backup rollers 35 and 36.

Next, a description on charging operations of the photosensitive belt 21 by such squeezing device will be made with reference to FIG. 5, which is a view for showing a circuit of the squeezing device according to the present invention.

Figure 5:
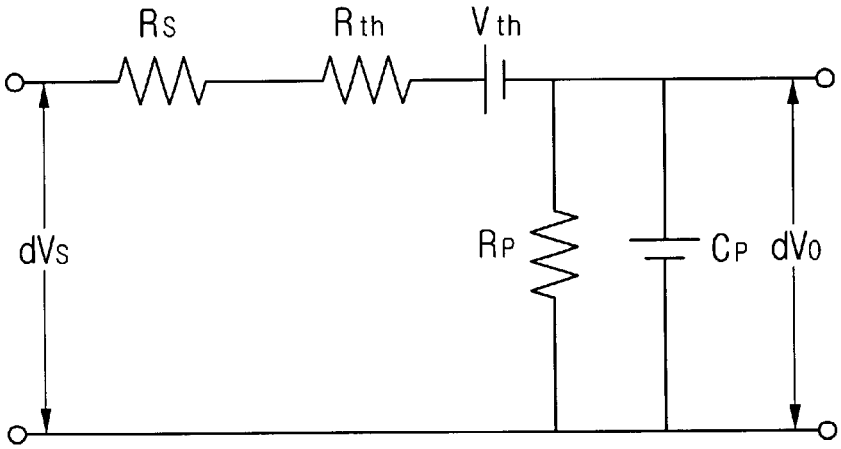
FIG. 5 is a view for showing electrical relations as to respective constituents of the squeezing device of FIG. 4 in an equivalent circuit diagram.

In FIG. 5, a reference numeral dVs is a value subtracting a potential $V_i$ of the photosensitive belt 21 prior to contacting with the squeezing roller 34, that is, prior to charging, from a squeeze potential Vs applied to the squeezing roller 34 by the bias applying unit 41, and dVo is a value subtracting a potential Vi of the photosensitive belt 21 prior to contacting with the squeezing roller 34 from a potential Vo formed at the photosensitive belt 21 after contacting with the squeezing roller 34, that is, after charging.

A reference numeral Rs is a resistance determined by an electricity conductivity of the contact layer 34*b* of the squeezing roller 34, and Rth is an equivalent resistance at a nip region on a townsend discharge occurrence. Further, Vth is a critical potential required for generating the townsend discharge, Rp is a resistance determined by an electricity conductivity of the photosensitive belt 21, and Cp is a capacitance of the photosensitive belt 21 of the nip region.

Meanwhile, the charging performance of the squeezing device is determined by the critical potential Vth, a charging time constant, and a charging time.

In the equivalent circuit of FIG. 5, the charging time constant becomes Rs×Cp.

By an experiment, in order to get a good charging performance of the photosensitive belt 21 by the squeezing device, it is required for a charging time to be more than five times greater than a charging time constant.

That is, since a charging time is proportional to a nip width Nw, the charging performance by the squeezing device becomes good as the nip width Nw and the charging time constant satisfy the following relationship of formula 2.

$$2R_1 \mathrm{SIN}^{-1}\left(\frac{R2}{R1+R2}\right) \geq 5Rs \times Cp \quad \text{[Formula 2]}$$

Meanwhile, as the nip width Nw increases, the capacitance Cp of the photosensitive belt 21 increases in proportion to the nip width Nw, but the resistance Rs of the squeezing roller 34 decreases, so the charging time constant does not undergo a big change.

As in Formula 2, if the nip width Nw formed by the plurality of backup rollers 35 and 36 becomes over five times more than the charging time constant, the charging time also becomes over five times more than the charging time constant, so a good charging performance can be obtained.

In the meantime, a relation between dVs, a difference value between the squeeze potential Vs applied to the squeezing roller 34 and the potential Vi before the photosensitive belt 21 is charged, and dVo, a difference value between a photosensitive belt potential Vo after being charged by the squeezing roller 34 and a photosensitive belt potential Vi before charging is as follows.

$$dVo=(dVs-V_{th})(1-e^{-t/\tau})=(dVs-V_{th})(1-e^{-(Nw/Vp)/\tau})$$

$$\tau=Rs\times Cp \quad \text{[Formula 3]}$$

Here, Vp denotes a rotation speed of the photosensitive belt 21, t denotes a charging time, and τ denotes a charging time constant. In the meantime, the difference value dVo between the photosensitive belt potential Vo after being charged by the squeezing roller 34 and the photosensitive belt potential Vi before charging indicates an output voltage in the equivalent circuit of FIG. 5.

Figure 6:
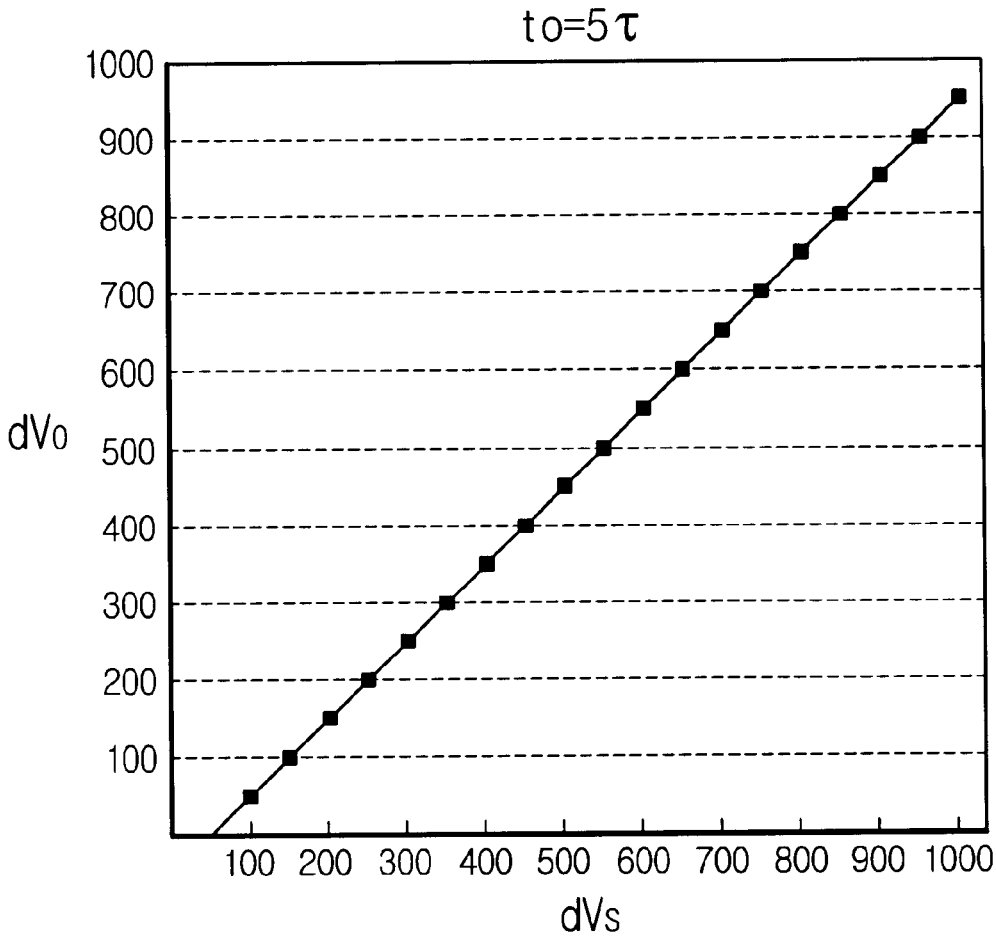
FIG. 6 is a graph for showing a charging performance of the squeezing device of FIG. 4.

FIG. 6 is a graph for showing results obtained from experiments of a charging performance of the squeezing device according to the present invention.

As shown in FIG. 6, in case that a charging time to is five times larger than a charging time constant τ, the values of dVo are nearly identical to the values of dVs. Accordingly, a potential difference between the image and non-image regions on the photosensitive belt 21 after charging becomes so small that the photosensitive belt 21 is evenly charged. Therefore, a reset state capable of forming a new electrostatic latent image can be provided.

In the squeezing device according to the present invention, the squeezing roller 34 removes carrier that is oversupplied to the photosensitive belt 21 and charges the photosensitive belt 21 by a bias applied by the bias applying unit 41, to thereby effectively enable the formations and developments of electrostatic latent images of different colors to be enabled.

In the meantime, if heat generated by the heater 43 is transmitted to the photosensitive belt 21 through the squeezing roller 34, a thermionic electron emission in the photosensitive belt 21 is activated, so the critical potential Vth for charging can be lowered.

A description on a function of the heater 43 is made in greater detail.

In general, the critical potential Vth at which the townsend discharge occurs is affected by temperatures. In a state in which a temperature of the surface (for example, a silicon layer) of the photosensitive belt 21 is low, the critical potential Vth becomes larger since the thermionic electron emission is not easy. Further, in a state that temperatures of ink and photosensitive belt 21 have risen higher due to operation of a printer for a long time, the critical potential Vth decreases since the thermionic electron emission from the surface of the photosensitive belt 21 increases.

That is, the higher the temperature of the silicon layer constituting the surface of the photosensitive belt 21, the lower the critical potential Vth becomes, since the thermionic electron emission of the silicon layer are facilitated. As a result, the townsend discharge occurs by a low electric field.

In the case that the heater 43 does not operate, the photosensitive belt 21 absorbs thermal energy from the transferring roller 27*b* that has the surface temperature maintained at about 100° C., and emits heat to supplied ink, passing through the developing units 30 of yellow (Y), cyan (C), magenta (M), and black (K) in order. Accordingly, the critical potential Vth upon charging becomes about 35V for the developing unit 30 for developing the yellow (Y) ink, about 80V for the developing unit 30 for developing the cyan (C) ink, and about 200V for the developing unit 30 for developing the magenta (M) ink. A reason for gradually increasing the critical potential Vth is because the temperature of the photosensitive belt 21 gradually falls.

However, if the heater 43 operates, through the surface of the squeezing rollers 34, that is, through the contact layers 34*b*, thermal energy is transferred to the surface of the photosensitive belt 21 so that the thermionic electron emission from the surface of the photosensitive belt 21 is facilitated, and the critical potential Vth becomes much lower. That is, by constantly maintaining the surface temperature of the photosensitive belt 21 with the operation of the heater 43, it is possible to reduce the critical potential below 40V regardless of the kind of the developing units 30.

The charging performance improves with lowering of the critical potential Vth. By experiments, in case of heating and maintaining the squeezing rollers 34 at 45° C., the charging efficiency is improved from 52% to 56%.

Further, by mounting the heater 43 to each of the squeezing rollers 34, since thermal energy generated from the heater 43 is transferred to the photosensitive belt 21, an evaporation rate of the carrier goes up and the squeezing efficiency increases and the drying load of the drying unit 25 is decreased.

As described above, with the squeezing device of a wet printer and a developing unit 30 employing the same according to the present invention, by securing a charging time of the photosensitive belt 21 sufficiently and enhancing the charging performance with lowering of a critical potential Vth for generating a townsend discharge occurrence, the printing quality can be enhanced.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A squeezing device of a wet printer for separating a liquid carrier element not used for forming an image from an ink supplied to a photosensitive belt, comprising:

a squeezing roller mounted to be contacted with the photosensitive belt;

a bias applying unit for biasing the squeezing roller at a certain potential; and a plurality of backup rollers mounted side by side to be opposite to the squeezing roller across the photosensitive belt, the photosensitive belt being placed between the plurality of backup rollers and the squeezing roller;

wherein a contact area of the squeezing roller and the photosensitive belt extends from a first of the plurality of backup rollers to a second of the plurality of backup rollers.

2. The squeezing device as claimed in claim 1, wherein the squeezing roller comprises:

a core to which a bias potential is applied to charge the photosensitive belt by the bias applying unit; and a contact layer surrounding an outer circumference of the core.

3. The squeezing device as claimed in claim 2, further comprising a heater mounted in the core for heating the contact layer.

4. A squeezing device of a wet printer for separating a liquid carrier element not used for forming an image from an ink supplied to a photosensitive belt, comprising:

a squeezing roller mounted to be contacted with the photosensitive belt;

a bias applying unit for biasing the squeezing roller at a certain potential; and a plurality of backup rollers mounted side by side to be opposite to the squeezing roller across the photosensitive belt, the photosensitive belt being placed between the plurality of backup rollers and the squeezing roller;

wherein the squeezing roller and the plurality of backup rollers are formed to satisfy a formula of:

$$2R_1 \mathrm{SIN}^{-1}\left(\frac{R2}{R1+R2}\right) \geq 5Rs \times Cp$$

where, $R_1$ is a radius of the squeezing roller, $R_2$ is a radius of the backup roller, Rs is a resistance of the squeezing roller, and Cp is a capacitance of the photosensitive belt.

5. A squeezing device of a wet printer for separating a liquid carrier element not used for forming an image from an ink supplied to a photosensitive belt, comprising:

a squeezing roller mounted to be contacted with the photosensitive belt;

a bias applying unit for biasing the squeezing roller at a certain potential;

a heater for heating the surface of the squeezing roller to a certain temperature; and a plurality of backup rollers mounted side by side to be opposite to the squeezing roller across the photosensitive belt, the photosensitive belt being placed between the plurality of backup rollers and the squeezing roller;

wherein a contact area of the squeezing roller and the photosensitive belt extends from a first of the plurality of backup rollers to a second of the plurality of backup rollers.

6. The squeezing device as claimed in claim 5, wherein the squeezing roller comprises:

a core to which a bias potential is applied to charge the photosensitive belt by the bias applying unit; and a contact layer for surrounding an outer circumference of the core, wherein the heater is mounted in the core.

7. A developing unit of a wet printer for developing an electrostatic latent image by supplying an ink to the photosensitive belt, comprising:

an ink supplying unit for supplying the ink to the photosensitive belt;

a squeezing roller mounted in contact with the photosensitive belt for separating a liquid carrier element, which is not used for forming an image, from the ink supplied to the photosensitive belt;

a bias applying unit for biasing the squeezing roller at a certain potential; and a plurality of backup rollers mounted side by side to be opposite to the squeezing roller across the photosensitive belt, the photosensitive belt being placed between the plurality of backup rollers and the squeezing roller;

wherein a contact area of the squeezing roller and the photosensitive belt extends from a first of the plurality of backup rollers to a second of the plurality of backup rollers.

8. The developing unit as claimed in claim 7, further comprising a heater for heating the squeezing roller.

9. The developing unit as claimed in claim 8, wherein the squeezing roller comprises:

a core to which the bias potential is applied to charge the photosensitive belt by the bias applying unit; and a contact layer surrounding an outer circumference of the core, wherein the heater is mounted in the core.

* * * * *